US005522705A

United States Patent [19]

Elaini et al.

[11] Patent Number: 5,522,705

[45] Date of Patent: Jun. 4, 1996

[54] FRICTION DAMPER FOR GAS TURBINE ENGINE BLADES

[75] Inventors: Yehia Elaini; Carl E. Meece, both of Jupiter, Fla.

[73] Assignee: United Technologies Corporation, Hartford, Conn.

[21] Appl. No.: 242,388

[22] Filed: May 13, 1994

[51] Int. Cl.[6] ..... F01D 5/26

[52] U.S. Cl. ..... 416/190; 416/191; 416/500

[58] Field of Search ..... 416/190, 191, 416/500

[56] References Cited

U.S. PATENT DOCUMENTS

| | | | |
|---|---|---|---|
| 2,610,823 | 9/1952 | Knowlton, Jr. | 416/190 X |
| 3,986,792 | 10/1976 | Warner | 416/191 X |
| 4,025,232 | 5/1977 | Imai et al. | 416/191 |
| 4,028,006 | 6/1977 | Kuroda et al. | 416/191 |
| 4,177,011 | 12/1979 | Eskesen et al. | 416/191 |
| 4,721,434 | 1/1988 | Marshall et al. | 415/191 |
| 5,156,529 | 10/1992 | Ferleger et al. | 416/190 |
| 5,281,097 | 1/1994 | Wilson et al. | 416/500 |

*Primary Examiner*—Edward K. Look
*Assistant Examiner*—Michael S. Lee
*Attorney, Agent, or Firm*—Marina F. Cunningham

[57] ABSTRACT

A friction damper (50) provides friction damping for gas turbine engine airfoils to reduce vibrations therein. The friction damper (50) includes a plate (52) underlying radially outer shrouds (30) of two adjacent airfoils (20). Friction generated between an outer surface (53) of the plate (52) and undersides (42) of the adjacent shrouds (30) reduces undesirable vibrations in the airfoils (20).

4 Claims, 4 Drawing Sheets fig. 1
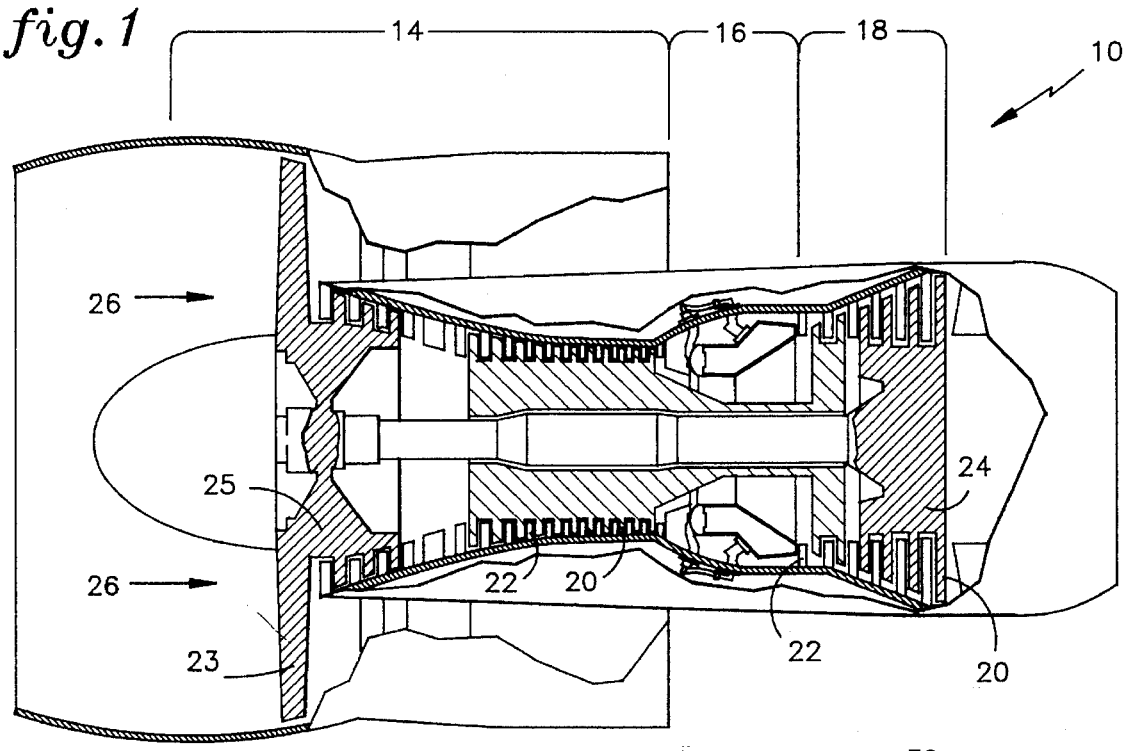
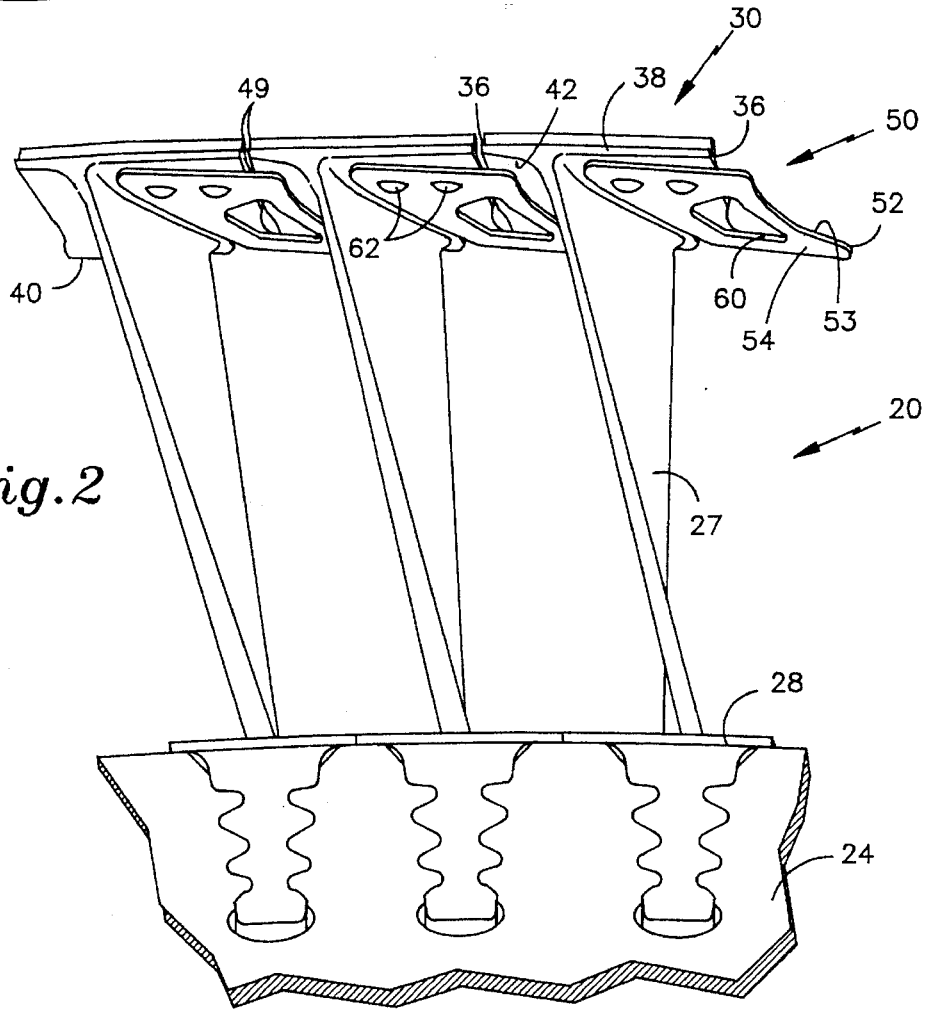
fig. 2

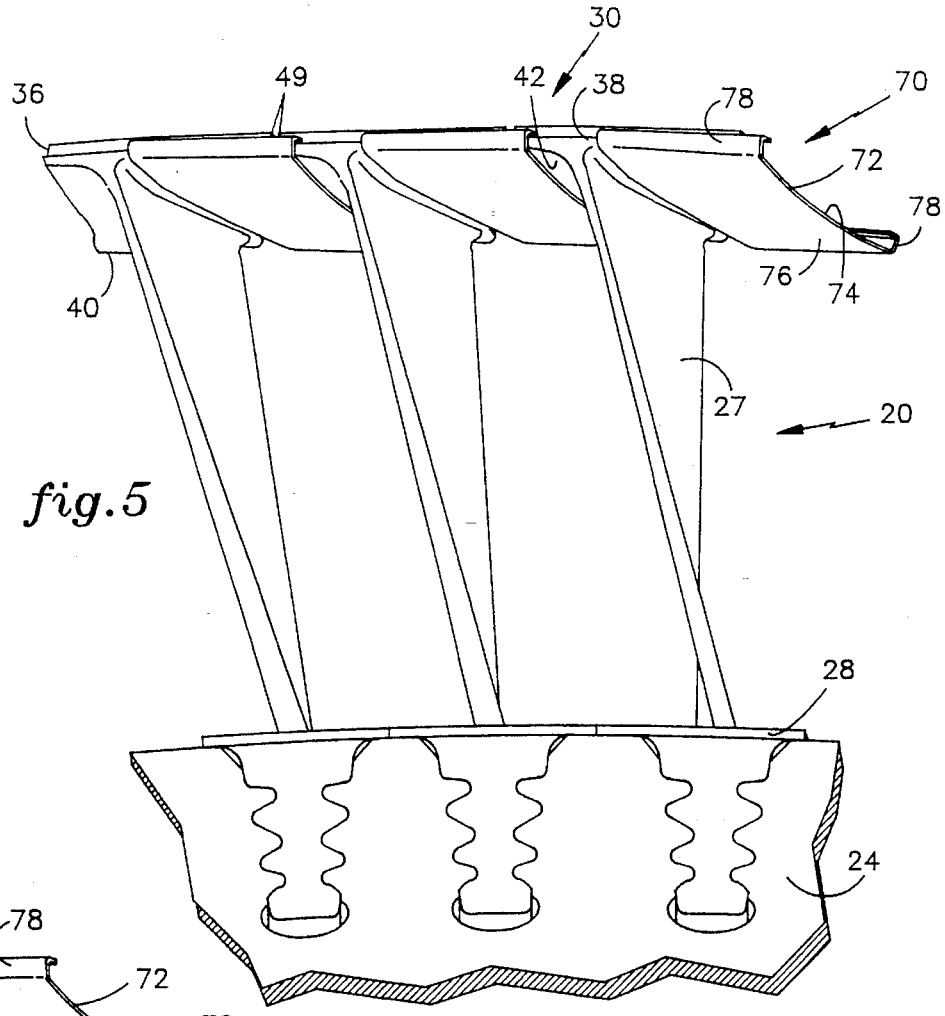
fig.5
fig.6
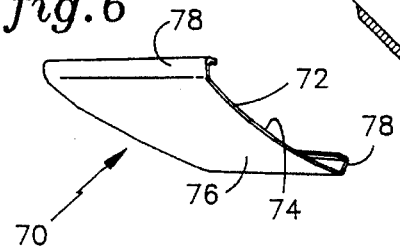
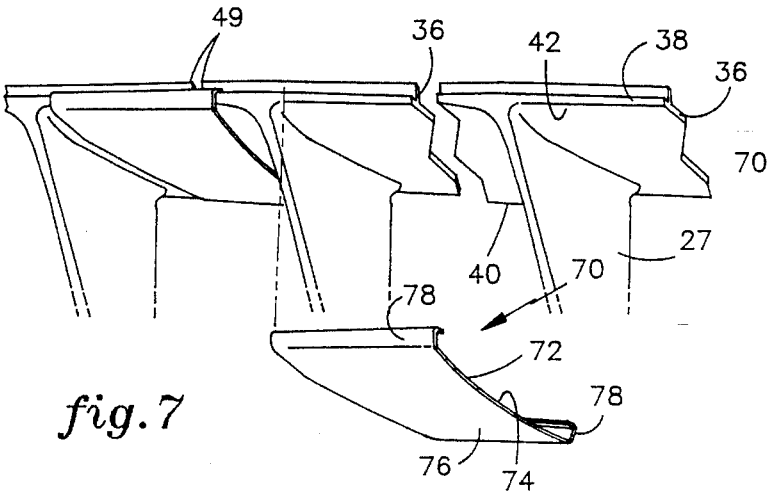
fig.7
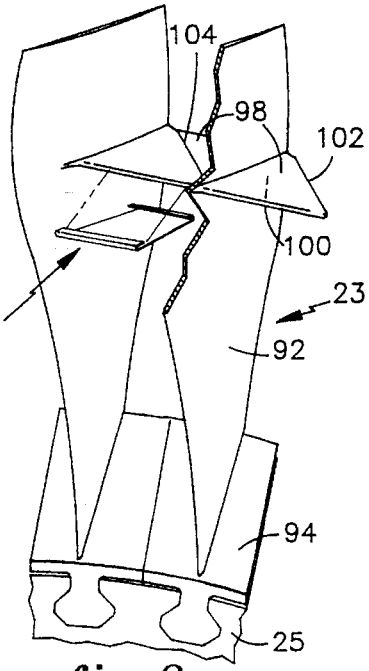
fig.9

FRICTION DAMPER FOR GAS TURBINE ENGINE BLADES

DESCRIPTION

1. Field of the Invention

This invention relates to gas turbine engines and, more particularly, to the reduction of vibrations within the airfoils therefor.

2. Background Art

A typical gas turbine engine includes a compressor, a combustor, and a turbine. Both the compressor and the turbine include alternating rows of rotating airfoils and stationary airfoils. The rotating airfoils, also referred to as blades, are secured in a rotating disk. Each blade includes an airfoil portion flanged by a platform at an inner radius of the blade, facilitating the attachment of the blade onto the disk. Air flows axially through the engine. Compressed air, emerging from the compressor, is mixed with fuel in the combustor and burned therein. The products of combustion, at high pressure, enter the turbine driving the turbine blades that are secured onto the disk. The expansion of the gases in the turbine produces thrust to propel the engine, and drives the compressor.

In general, the components of the gas turbine engine operate in a harsh environment characterized by high temperatures and vibrations. In particular, the rotating airfoils are subjected to high centrifugal loads that are frequently combined with vibrations. The various modes of vibration, including vibrations in circumferential, axial, and radial directions, translate into stresses on the blades that may cause failure within the blades, if not properly addressed.

The problem of vibrations in the blades of conventional engines is addressed by including an outer shroud disposed on the outer radius of each blade. Adjacent shrouds come in contact with each other to dissipate energy through friction at the interface, thereby alleviating vibrations. A drawback is that the edges of the shrouds at the point of contact wear out with time and can no longer reduce the vibrations, thus eliminating the mechanism for dissipation of energy.

Certain types of blades, such as fan blades, do not include an outer shroud because the outer shroud would significantly impede airflow and thus hinder performance. Fan blades frequently employ mid-span shrouds which are typically disposed on both sides of each blade at a mid-section thereof, so that the mid-span shrouds of any two adjacent blades interface. The contact between the mid-span shrouds produces friction and dissipates vibrational energy. The problem with mid-span shrouds is analogous to the problem with blades having an outer shroud. The surfaces of the mid-span shroud's interface also wear out, thereby significantly reducing their efficiency.

There are several other known approaches to handle the problem of vibrations in the blades. One approach is to fabricate more robust blades. However, this approach results in a weight penalty, since not only the weight of the blades themselves increases, but the weight of the associated hardware must increase as well to accommodate the heavier blades. This approach is undesirable because any additional weight reduces the efficiency of the engine.

Another known approach to reduce vibratory stress in gas turbine engine blades is to provide additional damping at undersides of radially inner blade platforms. The improvement in the damper performance is not substantial, since the amount of displacement at the platform is relatively small and, consequently, results in a small amount of damping.

One scheme employed in steam engines to inhibit circumferential motion between the shrouds is described in U.S. Pat. No. 3,986,792 entitled "Vibrational Dampening Device Disposed On a Shroud Member For a Twisted Turbine Blade". This device provides damping on the outer surface of the shroud. There are two reasons why the device cannot be utilized in gas turbine engines applications. First, the device inhibits only the circumferential mode of vibrations and does not address any other modes of vibration. Secondly, for the disclosed damper to be effective in gas turbine engines, the damper would have to be fabricated in a much heavier version, since the gas turbine engine blades are subjected to centrifugal loads that are greater than analogous loads acting on a steam engine by a factor of approximately 25. A thicker damper results in two undesirable consequences, additional weight for the engine and flow obstruction through the blades. Thus, there is still a great need to reduce vibrations in the gas turbine engine blades.

DISCLOSURE OF THE INVENTION

The object of the present invention is to alleviate vibratory stresses in the gas turbine engine airfoils with enhanced effectiveness and minimal weight penalty.

According to the present invention, a friction damper comprises a plate having an outer surface substantially conforming in shape to contoured undersides of adjacent airfoil shrouds. Rubbing contact between the friction damper and the contoured undersides of the two adjacent shrouds dissipates vibrational energy in the airfoils. The friction damper provides auxiliary damping to the airfoils, resulting in dual damping, since any two adjacent shrouds of two adjacent airfoils interface with each other generating friction therebetween and dissipating energy. As the shroud interface wears out, the friction damper provides sole damping for the blades.

The shrouds move significant amounts and therefore generate substantial friction between the shroud and the friction damper. In addition, the friction damper is capable of damping not only circumferential motion, but also provides enhanced damping for all modes of vibrations characterized by circumferential (easywise bending) modes, axial (stiffwise bending) modes, and radial (shroud rotation) modes. Furthermore, the damper is loaded by the centrifugal forces that push the damper against the shrouds thereby making damping more effective.

In an exemplary embodiment, approximately one half of the friction damper is fixedly attached to the underside of one shroud, whereas another half of the friction damper extends over to the underside of the adjacent shroud. Friction is generated between the outer surface of the unattached portion of the friction damper and the underside of the adjacent shroud. In an alternate arrangement, the friction damper includes a plate with an outer surface substantially conforming in shape to the contoured underside of the shroud with two sides clipped onto the two adjacent shrouds. Friction is generated during operation of the engine between the outer surface of the friction damper and the undersides of two adjacent shrouds.

In another embodiment, the friction damper is utilized in mid-shrouded blades, wherein approximately one half of the friction damper is fixedly attached to the underside of one mid-span shroud of the airfoil and the other half of the friction damper extends over to the underside of the adjacent mid-span shroud. Friction is generated between the outer surface of the unattached portion of the friction damper and the underside of the adjacent shroud. In an alternate arrangement, the friction damper includes a plate and two sides that clip onto the two adjacent mid-span shrouds.

A primary advantage of the present invention is that the friction damper reduces the rate of wear on the shrouds' interface, thereby prolonging dual damping. Another advantage of the present invention is that the friction damper does not obstruct the flow of gases, since the friction damper can be fabricated relatively thin and will still provide effective friction damping. A further advantage of the present invention is that the friction damper is light in weight and therefore does not reduce the overall efficiency of the engine.

The foregoing and other objects and advantages of the present invention become more apparent in light of the following detailed description of the exemplary embodiments thereof, as illustrated in the accompanying drawings.

BRIEF DESCRIPTION OF THE DRAWINGS

FIG. 1 is a schematic, partially sectioned elevation of a gas turbine engine employing the present invention;

FIG. 2 is an enlarged perspective view of an array of blades used in the gas turbine engine shown in FIG. 1 employing a friction damper according to the present invention;

FIG. 5 is an enlarged perspective view of an array of blades used in the gas turbine engine shown in FIG. 1 employing another embodiment of a friction damper according to the present invention;

FIG. 6 is a perspective view of the friction damper of FIG. 5;

FIG. 7 is an exploded, fragmentary perspective view of the shrouds with the friction damper of FIG. 6 attached thereto;

FIG. 9 is an enlarged perspective view of an array of mid-shrouded blades used in the gas turbine engine shown in FIG. 1 employing another embodiment of a friction damper according to the present invention.

BEST MODE FOR CARRYING OUT THE INVENTION

Figure 3:
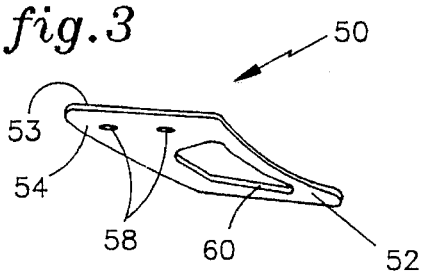
FIG. 3 is a perspective view of the friction damper of FIG. 2.

FIG. 1 illustrates a gas turbine engine 10, which includes a compressor 14, a combustor 16, and a turbine 18. Both, the compressor 14 and the turbine 18 include alternating rows of rotating airfoils 20 and stationary airfoils 22. The compressor 14 also includes fan blades 23. The rotating airfoils 20 are secured onto a disk 24, and the fan blades 23 are secured onto a disk 25. Air 26 flows axially through the engine 10. As is well known in the art, the air 26, compressed in the compressor 14, is mixed with fuel which is burned in the combustor 16 and expanded in the turbine 18, thereby rotating the airfoils 20 in the turbine 18 and the airfoils 20 and fan blades 23 in the compressor 14.

Figure 4:
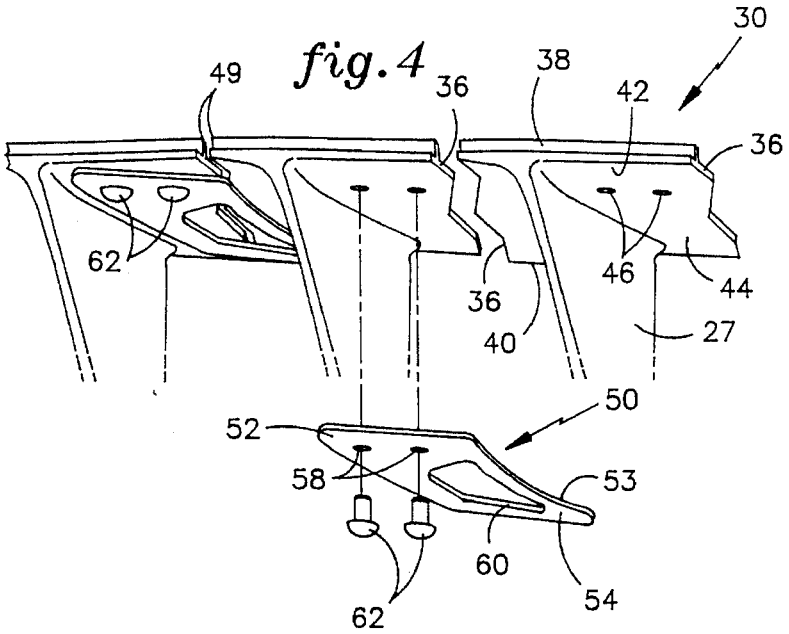
FIG. 4 is an exploded, fragmentary perspective view of shrouds with the friction damper of FIG. 3 attached thereto.

Referring to FIG. 2, each rotating airfoil 20 (blade) comprises an airfoil portion 27 flanged by a radially inner platform 28 and by a radially outer shroud 30. The shroud 30 is bounded by opposing contiguous edges 36, an upstream edge 38, and a downstream edge 40. The shroud 30 also includes a contoured underside 42 and a plurality of shroud holes 46 formed within the shroud 30, as best seen in FIG. 4. The shroud 30 of the blade 20 comes into contact at the contiguous edge 36 with contiguous edges 36 of adjacent blades 20 to form an interface 49.

A friction damper 50 is disposed on the, underside 42 of two adjacent shrouds 30. Each friction damper 50 comprises a plate 52 having an outer surface 53 and an inner surface 54, wherein the outer surface 53 substantially conforms in shape to the contoured underside 42. A plurality of damper holes 58 in the damper 50 register with the plurality of shroud holes 46, as best seen in FIG. 4. A cut-out 60 is formed within the plate 52 to reduce the weight of the damper 50. Approximately one half of the damper 50 underlies the shroud 30 and the other half of the damper 50 underlies the adjacent shroud 30 so that the outer surface 53 is in contact with the two adjacent undersides 42 of the two adjacent shrouds 30. Each damper 50 is riveted to the underside 42 of one shroud 30 by means of rivets 62 and overlaps the underside 42 of the adjacent shroud 30. Conversely, each shroud 30 has one damper 50 riveted to the underside 42 on one end thereof and the other damper 50 overlapping the underside 42 of the shroud 30 on another end thereof. The damper 50 generates friction, between the outer surface 53 overlapping the adjacent shroud 30 and the underside 42 of the adjacent shroud 30 that comes into contact therewith, to reduce undesirable vibration in the blades through damping. The damper 50 configuration provides sufficient in-plane stiffness essential for superior damping effectiveness for the circumferential and axial modes, while the low out-of-plane stiffness of the damper allows the adjacent shrouds to move radially relative to each other without being overly constrained.

Referring to FIGS. 5–7, a damper 70 operates under a similar concept as the damper 50. The damper 70 includes a plate 72 having an outer surface 74 and an inner surface 76, wherein the outer surface 74 substantially conforms to the contoured underside 42 of the shroud 30. The damper 70 further includes two folded sides 78 that mate with the upstream edges 38 and downstream edges 40 of the two adjacent shrouds 30. The sides 78 clip onto two adjacent shrouds 30.

In operation, the damper 70 is clipped onto the two adjacent shrouds 30 of the two adjacent blades 20. The damper 70 provides friction damping to the two adjacent blades 20 by generating sliding movement between the outer surface 74 of the damper 70 and each of the undersides 42 of the adjacent blades 20.

Figure 8:
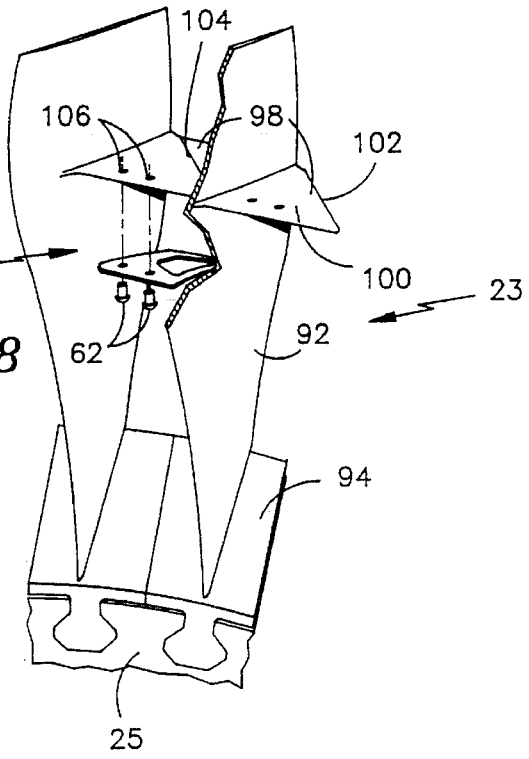
FIG. 8 is an enlarged perspective view of an array of mid-shrouded blades used in the gas turbine engine shown in FIG. 1, employing another embodiment of a friction damper according to the present invention.

The friction damper of the present invention can be used in mid-shrouded blades. Referring to FIG. 8, the fan blade 23, disposed in the compressor 14 of the engine 20, includes an airfoil portion 92 flanged by an inner radius platform 94. A mid-span shroud 98 is attached on each side of the airfoil portion 92 at a medial location thereof. The mid-span shroud 98 includes a contoured underside 100 and a contiguous edge 102 in contact with the contiguous edge 102 of the adjacent blade 23. The contiguous edges 102 of two adjacent mid-span shrouds 98 come into contact to form an interface 104. The mid-span shroud 98 also includes a plurality of mid-span shroud holes 106.

The friction damper 50 of FIG. 3 is fixedly attached to the underside 100 of the mid-span shroud 98 of the blade 23 and extends over to the underside 100 of the mid-span shroud 98 of the adjacent blade 23. The friction damper 50 is fastened to the mid-span shroud 98 of the blade 23 by means of rivets 62 that pass through the plurality of damper holes 58 and, the plurality of mid-span shroud holes 106. During the operation of the engine 10, friction is generated between the contiguous edges 102 of the mid-span shrouds 98 at the interface 104 and between the outer surface 53 of the damper 50 and the underside 100 of the mid-span shroud 98 of the adjacent blade 23.

The friction damper 70 of FIG. 6 can be attached to the undersides 100 of the two mid-span shrouds 98 of two adjacent blades 23, as shown in FIG. 9. Friction would be generated between the outer surface 74 of the damper 70 and each of the undersides 100 of the adjacent blades 23.

Figure 10:
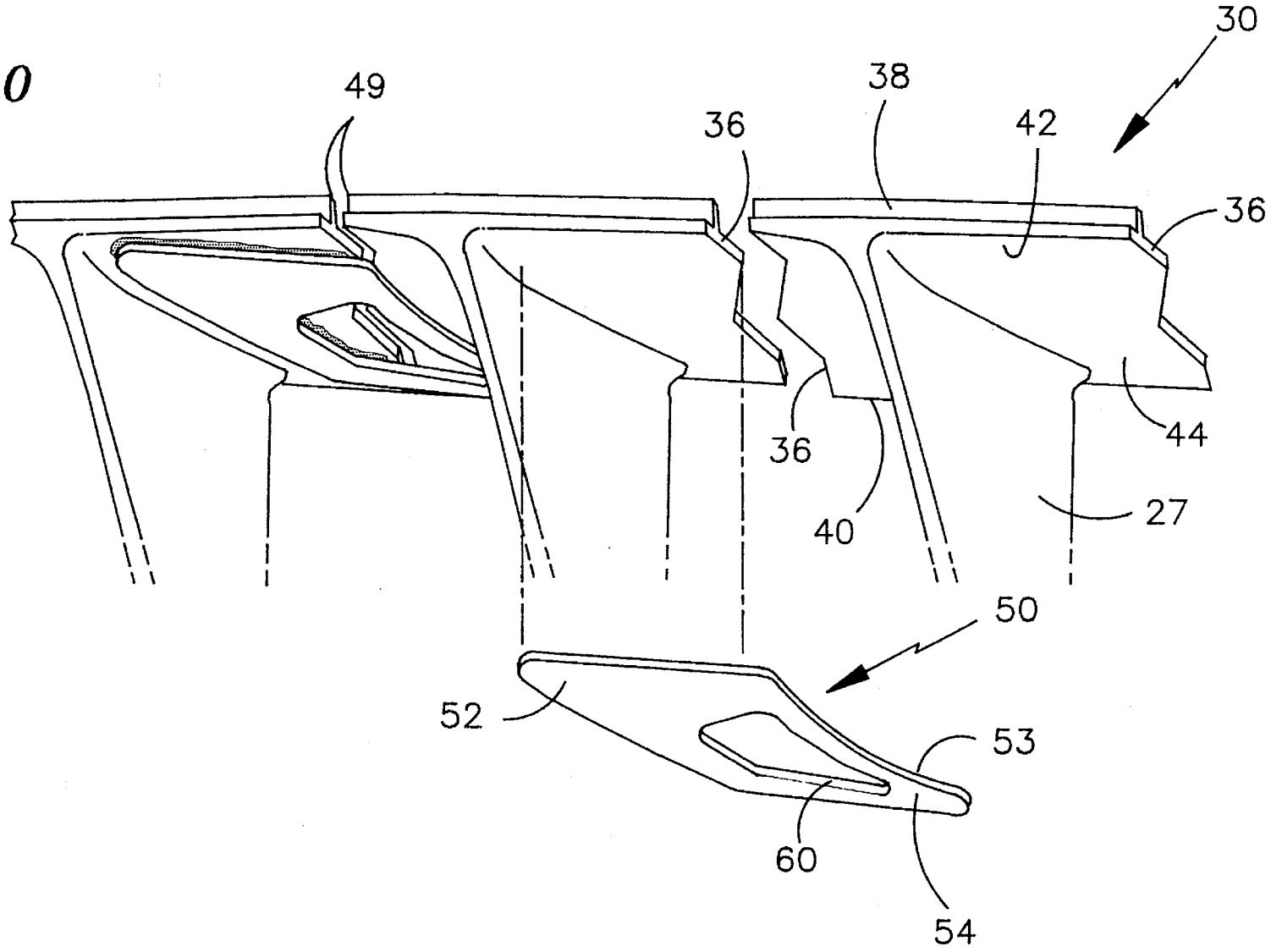
FIG. 10 is an exploded, fragmentary perspective view of a friction damper welded onto the shrouds of the blade, according to another embodiment of the present invention.

The damper 50 can be attached to the shroud 30 or mid-span shroud 98 by means of welding rather than riveting, as can be seen in FIG. 10. This method of attachment eliminates the need for the plurality of damper holes 58 and shroud holes 46, 106.

The friction damper for turbine use must be fabricated from a material capable of withstanding temperatures of up to 1800° F. For example, HAYNES® 188 is one heat resistant steel alloy that has the appropriate properties. INCONEL® 718 is another acceptable material for fabrication of the friction damper. HAYNES and INCONEL are registered trademarks of the Cabot Corporations and The International Nickel Company, Inc., respectively.

The friction damper 50 or 70 can be manufactured in various thicknesses. However, if fabricated too thin, the friction damper can wear out and distort with time, thereby becoming less effective. If the friction damper is fabricated to be too thick, it results in an excessive weight penalty, overly constrains the blade, and also impedes airflow. The optimum thickness for the friction damper for the typical low pressure turbine engine is in the range of 0.016 inches to 0.032 inches.

The friction damper 50, 70 can be manufactured either with or without the cut-out 60. The benefit of having the cut-out 60 is that it reduces the overall weight of the friction damper. Thus, although the friction damper 50 is depicted in FIG. 3 as having the cut-out 60, another version of the friction damper without the cut-out is also functionally equivalent. Similarly, although the friction damper 70 is depicted in FIG. 6 without a cut-out, a friction damper of FIG. 6 with a cut-out will be also functionally equivalent.

Although the friction damper 50, 70 is depicted as attached to every shroud, it is possible to have the friction damper 50, 70 attached to every other shroud or as frequently as needed.

During operation of the engine 10, the blades 20, 23 are subjected to extreme centrifugal loads that result in vibration stresses thereon. Friction dissipates energy which reduces the vibratory stress on the blades 20, 23. The magnitude of the vibratory stress is reduced when the contiguous edges of two adjacent shrouds of two adjacent blades 20, 23 are engaged with each other at the interface 49, 104 (respectively) to produce friction. The friction damper 50, 70, loaded by the centrifugal forces, generates additional friction between the outer surface of the damper and the undersides of the adjacent shrouds. As the mating edges of the shrouds wear out over time, the friction between the damper and shrouds will continue, thereby providing the desired damping. Furthermore, the friction damper reduces the rate of wear on the contiguous edges 36, 102 at the interface 49, 104.

Although the invention has been shown and described with respect to exemplary embodiments thereof, it should be understood by those skilled in the art that various changes, omissions, and additions may be made thereto, without departing from the spirit and scope of the invention.

We claim:

1. A friction damper for providing damping to two adjacent airfoils within a gas turbine engine, said airfoils being arranged axially in a circumferential row, each said airfoil having a pair of tip shrouds on each side thereof so that any two adjacent shrouds are in contact, said said tip shroud having contoured undersides on a radially inner side thereof, said friction damper characterized by:

a plate substantially conforming in shape to said contoured underside of said tip shroud, said plate being fixedly attached to said underside of one said tip shroud of said airfoil and in contact with said adjacent underside of said adjacent tip shroud of said adjacent airfoil, wherein a substantial portion of said plate making contact with said adjacent underside of said adjacent tip shroud.

2. The friction damper according to claim 1, characterized by said plate being fixedly attached to said shroud by means of welding.

3. The friction damper according to claim 1, characterized by:

said shroud having a plurality of shroud holes;

said plate having a plurality of damper holes disposed in register with said plurality of shroud holes; and a plurality of rivets, riveted through said plurality of shroud holes and said plurality of damper holes.

4. The friction damper of claim 1 characterized by said plate having a cut-out formed therein.

* * * * *